US005743568A

United States Patent [19]

Smith, III

[11] Patent Number: 5,743,568

[45] Date of Patent: Apr. 28, 1998

[54] BLOCKING LABEL FOR IDENTIFICATION PROTECTIVE COVERS

[76] Inventor: Steele Clarke Smith, III, 2166 W. Broadway, #100, Anaheim, Calif. 92804

[21] Appl. No.: 656,052

[22] Filed: May 31, 1996

[51] Int. Cl.[6] ..... B12D 15/00

[52] U.S. Cl. ..... 283/65; 283/116; 283/81; 283/75

[58] Field of Search ..... 283/81, 75, 74, 283/65, 117, 111, 116

[56] References Cited

U.S. PATENT DOCUMENTS

| | | | |
|---|---|---|---|
| 2,666,655 | 1/1954 | Wolowitz | 283/75 X |
| 3,283,713 | 11/1966 | Wooster | 283/75 X |
| 3,958,690 | 5/1976 | Gee, Sr. | 283/75 X |
| 4,514,919 | 5/1985 | Plutsky | 40/159 |
| 5,209,114 | 5/1993 | Hebert | 283/81 |
| 5,326,654 | 7/1994 | Will et al. | 283/81 X |

*Primary Examiner*—Willmon Fridie, Jr.
*Attorney, Agent, or Firm*—Maria Erlinda C. Sarno

[57] ABSTRACT

A blocking label is provided for use with protective covers enclosing inserts such as identification cards. The blocking label is custom cut and applied on the clear outside surface of the protective cover to cover a desired information contained on the information bearing surface of an insert which is visible through the clear outside surface of the protective cover. The blocking label is coated with an adhesive that is compatible with the clear material of the protective cover and the blocking label to achieve a semi-permanent adhesion of the blocking label to the protective cover.

17 Claims, 1 Drawing Sheet

BLOCKING LABEL FOR IDENTIFICATION PROTECTIVE COVERS

BACKGROUND

Inserts such as an identification card are frequently slipped through a protective cover for preservation. The protective covers for identification cards are usually made of clear plastic to enable a reader to read the data or information printed on the face of the identification card without necessitating the removal of the card from the protective cover. Insert as used herein is a card or object inserted into a protective cover such as a driver's license, professional identification card, student identification card, credit card, passport, insurance identification card and the like.

Protective covers are known in the art. The most common of these is made by sealing the three sides of two sheets, keeping a fourth side open for the insert to be introduced therethrough.

The present invention relates to the use of an adhesively backed opaque material, supplied as a component of a blocking label, for selectively covering information or data contained in the information bearing surface of an insert. The adhesive backed opaque material is typically made of a plastic material, preferably those belonging to a series of flexible vinyl films or polyesters. The purpose of the adhesive backed opaque material is to provide a means for the user to cover selected information printed on the face of the insert. For example, some people, especially those with information sensitive profession, prefer some information on the identification card blocked off from view.

Labels such as adhesive backed paper or adhesive backed plastic tapes are typically used to identify articles but may also be used, though not usually, to block off old information, cracks, or other defects on the surface of an article. These adhesive backed labels or tapes usually peel off with time, wears out or are not aesthetically designed for business use. The present invention provides an adhesive backed opaque material that will stay with more permanency on the surface to which it is applied, withstanding ordinary wear and tear, yet can still be peeled off cleanly when desired. For example, on relocation, when a party acquires a new driver's license from another state, the information one desires to block off may be in another location of the insert. On this occasion, rather than changing the entire protective cover, one can just peel off the old opaque material and apply a new one on the new position. This ability to reuse the protective cover by merely replacing the opaque material for a different type of insert is achieved by selecting the plastic material or surface to which the opaque material will be applied, and the type of adhesive applied at the back of the opaque material.

An identification card with a blow on label is disclosed in U.S. Pat. No. 5,209,514. The identification card consists of a base stock, typically made of bond paper, adhered to a transparent plastic surface with a release liner in between the base stock and the transparent plastic surface. The release liner is of a composition that will not permanently adhere to the adhesive such as waxed or silicone treated paper. On the release liner are one or more stickers which are connected to the release liner by a releasable repositional adhesive such as those sold by 3M of Minnesota Mining under the trademark "Post-it®". These stickers connected to the release liner have differing data printed on their faces. In usage, the sticker with the proper information is removed from the release liner and placed at the appropriate blank space located on the permanent printed information on the base stock of the label. This invention provides a label that can be shipped to different locations because the user can simply choose the proper sticker with the correct information and stick this to the appropriate blank spaces of the label with the permanent information. In contrast to the present invention, the above stickers are used to provide the correct information rather than block information on the information bearing surface of an insert.

U.S. Pat. No. 4,514,919 discloses the use of a strip of opaque material placed adjacent to the edge of a pocket on which may be written desired information. The opaque material as used does not block the photograph inside the storage apparatus.

U.S. Pat. No. 5,346,259 disclose a means for manufacturing anti-theft labels. This type of labels have as its purpose, to manufacture labels that are tamper proof to prevent label switching or counterfeiting of labels. The label is multilayered, held together by different types of adhesives, comprising a fragile easily tearable segment, a sturdy support layer and/or layers with imprinted pattern having an image visible only with the aid of a specially designed authentication viewer. The label of this invention is to prevent tampering whereas those of the present invention is to block off information to protect the user from unnecessary divulging of information.

SUMMARY OF THE INVENTION

Protective identification covers typically house an insert identification card to preserve the card from wear and tear without removing from view, the information content printed on the card. In ordinary usage, not all data contained in these identification cards are needed in the everyday transaction such as the address of the cardholder. With the increase of crime and pranks, a need to block off from view, some personal information such as one's address has arisen. One solution as disclosed in the author's other invention is to permanently imprint an opaque material on the surface of the protective cover at a location that will sit on top or above the information sought to be blocked when the identification card is fully inserted into the protective cover. While this approach blocks off selected information from view and offers the advantage of permanency of the blocking material so as to withstand wear and tear, each protective cover has to be individually catered to a particular identification card. For example, the location of the address in a California Driver's License will be different from those issued in another state. This approach provides less flexibility than the present invention and will also result in a higher manufacturing cost.

It is therefore an object of the present invention to provide a semipermanent blocking label to protect from view certain information printed on the information bearing surface of an identification card.

It is a further object of this invention to provide a means whereby a semipermanent blocking label can be positioned and centered perfectly above the information desired to be blocked.

It is a further object of this invention to provide a semipermanent blocking label that will stick well on the surface of a selected protective cover by careful choice of the adhesive applied at the back surface of an opaque material so as to be compatible with the plastic surface to which it is adhered to.

To accomplish the foregoing objects and advantages, a blocking label, having an adhesive backed opaque material, preferably made of a flexible plastic material, is cut to a desired size and provided to the user with a protective identification cover of choice. The blocking label is made up of at least two (2) layers, a support layer and a layer of an opaque material, preferably made of a flexible vinyl or polyester plastic material. The support layer is typically made of ordinary white paper, surface coated with polyethylene, with one side further coated with wax or silicone to serve as a release liner for the opaque material. One side of the opaque material is coated with an adhesive, preferably made of an acrylic based material. The adhesive backed opaque material is temporarily attached to the release liner before use.

To cover the information desired to be blocked off from view, the information bearing insert is inserted fully into a protective cover. The opaque sticker is then peeled off from the release liner of the support layer and positioned on the outer surface of the protective cover to lay directly in front of the selected information visible from the surface of the protective cover. The outer surface of the protective cover should be clean, dry, and contain no grease or residue to achieve maximum adhesion.

DETAILED DESCRIPTION OF THE INVENTION

Figure 1:
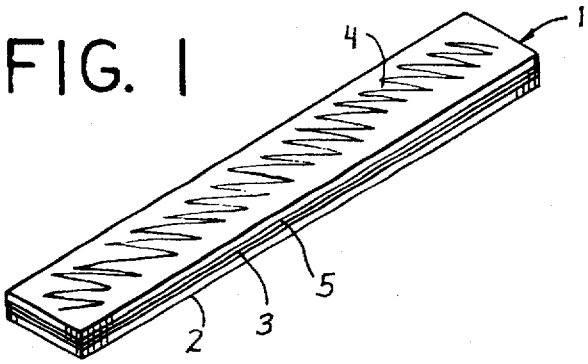
FIG. 1 is a perspective view of the blocking label showing the two major layers and coatings.
Figure 2:
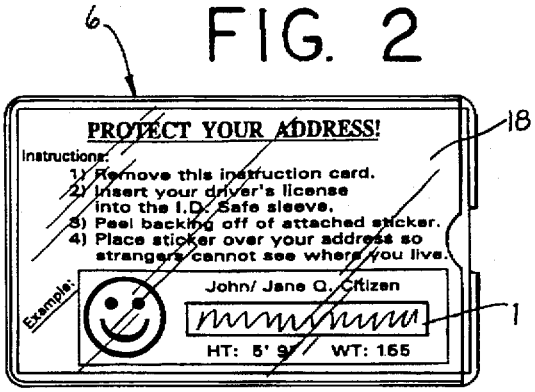
FIG. 2 is a plan view of the packaged product.

The present invention is produced as an individual blocking label 1 which is made of at least two layers. The support layer 2 is made of ordinary white paper of a desired mil thickness. The paper used is preferably surface coated on both top and bottom or back sides with polyethylene with one side further coated with silicone or wax to serve as a release liner 3 for the other layer 4 of opaque material, preferably made of flexible vinyl, polyester or polyethylene terephthalate plastic material. The back surface of the opaque material is coated with an adhesive 5 of a chosen composition so as to have compatible adhesion property with the surface to which it will ultimately be applied to, here the surface of the protective cover and the surface of the opaque material. An adhesive preferably applied for an application disclosed here is a water based acrylic. A rubber based acrylic can also be used for the same application. The adhesive backed opaque material preferably made of flexible vinyl, polyester or polyethylene terephthalate is hereinafter referred to as opaque plastic sticker 4. The adhesive coated side of the opaque plastic sticker is temporarily adhered to the release liner 3 prior to use as shown in FIG. 1. The blocking label is custom cut to a desired dimension, preferably rectangular in shape. The blocking label 1 is separately prepared and packaged with a selected protective cover 6 as shown in FIG. 2. For aesthetic purpose and convenience, the back or bottom surface of the support layer 2 of the blocking label 1, one facing opposite the opaque plastic sticker 4, may be glued to a card 18 with printed instructions on the use of the blocking label as shown in FIG. 2. A glue that is preferably used to stick the back of the blocking label to the instruction card is the "uhu stic" made in West Germany and distributed by FaberCastell® of Lewisburg, Tenn. 37091. Other glues and pastes available in the stationery stores may also be used.

Protective covers are known in the art and are typically made of a first flexible conformable polymeric sheet 7 having a generally planar top surface, hereinafter referred to as front sheet and a second flexible conformable polymeric sheet 8 having a generally planar bottom surface, hereinafter referred to as rear sheet. Examples of polymeric material that can be used to fabricate the sheets are binder grade polyvinyl alcohol, polyvinyl acetate, polyvinyl chloride, polypropylene, polysulfone, polyurethane, cellulose acetate, polycarbonate, thermoplastic rubber, polyester. However, for this invention, the plastic surface has to be carefully chosen so as to be compatible in its adhesion properties with the opaque plastic sticker 4. For example, the protective cover to be used with the opaque plastic sticker described here should have a plastic surface made of polyvinyl chloride, acetate, or polypropylene. The front sheet 7 and the rear sheet 8 each have a generally rectangular configuration and each define four outer peripheral edges, two longitudinal edges 7*a* and 7*c* for the front sheet and 8*a* and 8*c* for the rear sheet and two lateral edges 7*d* and 7*b* for the front sheet and 8*d* and 8*b* for the rear sheet. Depending upon the use of the protective cover, the front sheet may be identified or referred to as the top sheet. Likewise, the rear sheet can be referred to as the bottom or back sheet. The nomenclature, top and bottom, is usually used when the second rear sheet 8 lays flat on its lower surface with the front sheet 7 on top of the rear sheet 8. The front and rear sheets are preferably fabricated from plastic. The plastic may be both transparent, or one transparent and one non-transparent. The sheets are of sufficient thickness to provide substantial rigidity to the front and rear sheets, preferably between 0.006 to 0.02 inches.

Figure 3:
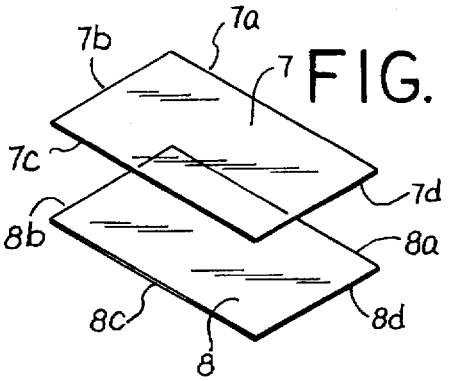
FIG. 3 is an exploded perspective view of two sheets, one on top of the other.
Figure 3A:
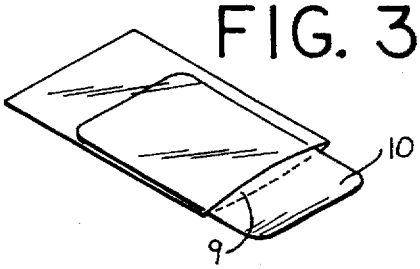
FIG. 3*a* is a perspective view showing an insert slidably inserted through the open edge.
Figure 4:
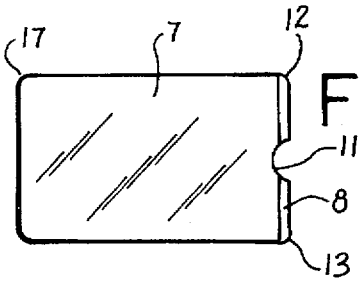
FIG. 4 is a front view of a protective cover.

The front 7 and rear 8 sheets are placed in substantial congruent relation and three sides, two longitudinal edges and one lateral edge or two lateral edges and one longitudinal edge are continuously sealed, leaving a fourth side 9 open to form a pocket between the front sheet and the rear sheet for receiving an insert 10 and to allow repeated insertion and removal of an insert as shown in FIG. 3*a*. An insert is a card or an object slidably inserted into the protective cover. Examples of inserts are driver's license, professional identification card, student identification card, credit card, insurance identification card and the like. It is preferred that the rear sheet 8 includes a side longer than a corresponding side of the front sheet 7 as shown in FIG. 4. Although FIG. 4 shows the opening on the right side, the open end can be on any one of the sides. Optionally, for the user's convenience, a semicircular thumb hole 11 is cut, preferably midway between the top side margin 12 and bottom side margin 13 of the open edge 9. The semicircular thumb hole cut catches on both the front 7 and rear 8 sheets as shown in FIG. 4. The front and rear sheets are continuously sealed along the three peripheral edges by various methods known in the art such as thermal fusion, gluing, radio frequency sealing, ultrasonic sealing and the like.

Figure 5:
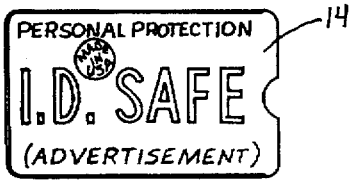
FIG. 5 is a back view of a protective cover.

On a protective cover with a non-transparent rear sheet 8, on the exposed outside surface 14 may be printed decorative, informative, or amusing indicia or the like as shown in FIG. 5.

Figure 6:
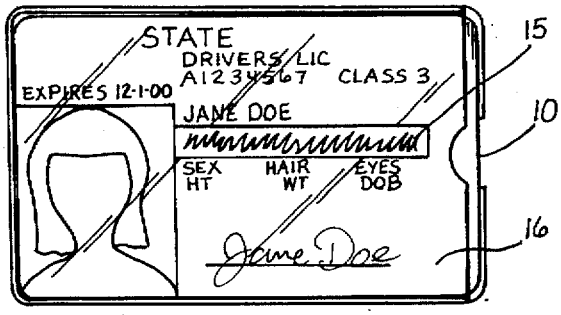
FIG. 6 is a plan view showing a blocked driver's license fully inserted into the protective cover.

To cover the information desired to be blocked off from view, the opaque plastic sticker 4 is peeled off from the release liner 3 of the blocking label 1. The opaque plastic sticker is positioned on a selected space at the outer exposed surface of the protective cover so as to lay directly in front of the selected information, data or verification signature 15 on an information bearing surface 16 of the insert 10 that is to be blocked off, when the insert 10 is fully inserted inside the protective cover as shown by FIG. 6. The exact position and size of the plastic sticker 4 which can be applied on either the front, rear, or both surfaces of the protective cover, depend upon the design of the information bearing surface of the insert. The opaque plastic sticker 4 is usually applied on the outside surface of the protective cover 6. The outer surface of the protective cover should be clean, dry, and contains no grease or residue to achieve maximum adhesion. The opaque plastic sticker 4 is cut and customized to fit on top of the selected information printed on the insert 10 that is visible through the plastic sheet of the protective cover 6. If the blocking label is to be used to cover the address information on a driver's license issued in the United States, the blocking label is preferably cut to a dimension that will cover the address portion of any state's driver license so as to provide flexibility of usage. Using the orientation shown in FIG. 4, the blocking label is typically rectangular in shape with a dimension of approximately 4.5 centimeter in length and approximately 0.7 cm in width. These dimensions can block any address portion of any U.S. issued driver's license to allow flexibility of usage anywhere in the United States. There may be more than one opaque plastic sticker or there may be other configuration desired depending upon the shape or space occupied by the information desired to be blocked. If desired, the corners 17 of the protective cover 6 are rounded to conform for example, with the rounded edge of the California driver's license.

The size of the protective cover may correspond to the entire length and width of the insert enabling the protective cover to completely envelope the insert between the front sheet and rear sheet. The exact dimensions will vary depending upon the size of the insert that will be introduced into the pocket. The protective cover's pocket dimension is typically 0.05–0.1 of an inch larger than the insert, just enough to accommodate the thickness of the insert. If the thickness of the insert is unusually thicker than an ordinary identification card, adjustments in the dimensions of the protective cover should be made to correspond to the thickness of the insert. When the insert is inside the protective cover, the rear sheet 8 lays flat against the back surface of the insert while the front sheet 7 lays flat against the front surface of the insert, thereby preventing the insert from sliding out of the protective cover.

The protective cover described above is for a single protective cover. A plurality of single protective covers catering to different types of insert may also be bound together along one edge common to all the individual units of single protective cover.

Changes may be made in the above product without departing from the scope of the invention herein. It is intended that all matter contained in the above description or shown in the accompanying drawing shall be interpreted as illustrative and not in a limiting sense.

What is claimed is:

1. A method for blocking a selected information in an information bearing insert, comprising the steps of:

selecting a protective cover made of a selected plastic material having a four edged front sheet and a four edged rear sheet, at least one sheet having a clear surface, the front and rear sheets continuously sealed on three edges leaving an edge open;

sliding an insert into the open edge between the front sheet and the rear sheet of the protective cover, the insert having an information bearing surface;

choosing a blocking label having an opaque material, an adhesive coated on one side of the opaque material, the adhesive having a composition compatible in adhesive property with the selected plastic material of the protective cover and the opaque material; and, covering a selected portion of the protective cover with the opaque plastic material, the portion on top of an information in the insert selected to be blocked, the information viewable through the clear surface of the protective cover.

2. A blocking label for covering a selected space at the outer exposed surface of a protective cover, in front of an information bearing surface of an insert, the protective cover made of a clear plastic material selected from the group consisting of polyvinylchloride, acetate, and polypropylene, comprising:

a support layer having two sides, a top and a bottom side, the top side coated with wax or silicone, the silicone or wax coating acting as a release liner; and, an opaque material coated on one side with an adhesive compatible in adhesion property with the opaque material and the clear plastic material of the protective cover, the opaque material temporarily attached to the support layer on the side coated with wax or silicone for easy release when peeled off for covering a portion of the protective cover.

3. The blocking label of claim 2 wherein the opaque material is made of a flexible vinyl plastic material.

4. The blocking label of claim 2 wherein the opaque material is made of a flexible polyester plastic material.

5. The blocking label of claim 2 wherein the adhesive is an acrylic based material.

6. The blocking label of claim 2 wherein the support layer is coated with polyethylene prior to coating the side with wax or silicone.

7. A driver's license protective cover with a blocking device consisting essentially of:

a protective cover having at least one surface made of a clear material, a four edged front sheet and a four edged rear sheet, the front and rear sheets continuously sealed on three edges leaving an edge open, forming a pocket for insertion therethrough; and, a blocking label applicable on one surface of the protective cover having an opaque material and an adhesive coated on one side of the opaque material, the adhesive having a composition compatible in adhesive property with the clear material of the protective cover and the opaque material.

8. The protective cover of claim 7 wherein the opaque material is made of a flexible vinyl plastic material.

9. The protective cover of claim 7 wherein the opaque material is made of a polyester plastic material or polyester plastic material.

10. The protective cover of claim 7 wherein the clear material is made of plastic selected from the group consisting of polyvinyl chloride, acetate and polypropylene.

11. The protective cover of claim 7 wherein the adhesive is an acrylic based material.

12. An insert protective cover with a blocking device, comprising:

a protective cover having at least one surface made of a clear material, a four edged front sheet and a four edged rear sheet, the front and rear sheets continuously sealed on three edges leaving an edge open, forming a pocket for insertion therethrough; and, a blocking label applicable on one surface of the protective cover having an opaque material coated on one side with an adhesive compatible in adhesion property with the opaque material and the clear material of the protective cover.

13. The insert protective cover of claim 12 wherein the clear material is made of plastic selected from the grasp consisting of polyvinyl chloride, acetate and polypropylene.

14. The insert protective cover of claim 12 wherein the opaque material is made of a flexible vinyl plastic material.

15. The insert protective cover of claim 12 wherein the opaque material is made of a polyester plastic material.

16. The insert protective cover of claim 12 wherein the adhesive or one side of the opaque material is an acrylic based material.

17. The blocking label of claim 2 wherein the bottom side of the support layer is glued to a card.

* * * * *